United States Patent [19]

Thro et al.

[11] Patent Number: 4,740,248

[45] Date of Patent: Apr. 26, 1988

[54] APPARATUS AND METHOD FOR CLEANING A LENS SYSTEM

[75] Inventors: Dennis E. Thro; Mort J. Nierenberg, both of Lancaster, Pa.

[73] Assignee: RCA Corporation, Princeton, N.J.

[21] Appl. No.: 913,518

[22] Filed: Sep. 30, 1986

[51] Int. Cl.[4] ..... B08B 5/04

[52] U.S. Cl. ..... 134/21; 134/1; 134/11; 134/25.1; 134/25.4; 134/31; 134/26

[58] Field of Search ..... 134/25.1, 25.4, 21, 134/11, 31, 26

[56] References Cited

U.S. PATENT DOCUMENTS 4,263,054 4/1981 Giambalvo ..... 134/26

4,584,481 4/1986 Matey ..... 250/459.1

FOREIGN PATENT DOCUMENTS 2143755 2/1985 United Kingdom ..... 134/21

*Primary Examiner*—Asok Pal

*Attorney, Agent, or Firm*—E. M. Whitacre; D. H. Irlbeck; T. H. Magee

[57] ABSTRACT

An apparatus and method for cleaning a lens system utilizes a rotating turntable that sequentially moves a plurality of lenses parallel to a shielding plate from a preexposed position to an exposed position located adjacent an aperture in the shielding plate. The apparatus includes a first manifold for directing a first flow of gas across a surface of a lens located at the preexposed position, and a second manifold for directing a second flow of gas across a surface of a lens located at the exposed position. First and second vacuum nozzles remove, respectively, airborne particles within the first and second gas flows. An additional nozzle mounted adjacent the aperture provides an ionized gas.

15 Claims, 2 Drawing Sheets

APPARATUS AND METHOD FOR CLEANING A LENS SYSTEM

BACKGROUND OF THE INVENTION

This invention pertains to an apparatus and method for cleaning a lens system and, in particular, the three rotating lenses of a 3-in-1 lighthouse.

In manufacturing cathode-ray tubes for use in color television, a panel assembly is formed which includes an apertured shadow mask mounted in a faceplate panel adjacent to a cathodoluminescent screen. The screen comprises a pattern of red, green and blue phosphors surrounded by a black matrix on the inside of the panel. Phosphor slurries and a black matrix application are deposited on the inner surface of the panel utilizing chemical photoresist processes which use photoresist films. The shadow mask is utilized as a photolithographic mask during steps which expose the photosensitive films to light. The light exposure steps are carried out on a photoexposure apparatus known in the art as a "lighthouse".

The lighthouse is designed to expose the photosensitive films by projecting light from a small area radiation source through the shadow mask. Beams of light pass through the apertures of the shadow mask to form a pattern, substantially of the same shape as the apertures in the mask, on the photosensitive films. The lighthouse is designed so that these beams of light follow the same trajectories through the shadow mask as will the electron beams in the finished product. Since the color cathode-ray tube uses three electron guns (one for each of the three colors red, green and blue), the lighthouse will generally have some provision for adjusting the position of the light source and adjusting the optics of the lighthouse to mimic the effect of the three different electron guns.

A 3-in-1 lighthouse is used to form the black matrix in the regions where the electron beams will not fall. In constructing the black matrix, a negative photoresist film, which hardens on exposure to ultraviolet (UV) light, is applied to the inner surface of the panel and exposed three times in the 3-in-1 lighthouse from all three color-center positions using three different trimmer lenses (one for each color) supported by a rotatable turntable. After development of the negative photoresist film, the surface contains a plurality of photoresist dots in the positions later to be openings in the matrix. Next, a water suspension of graphite is slurried on the surface and dried. An aqueous solution of hydrogen peroxide is then used to develop the matrix. The hydrogen peroxide disintegrates the photoresist dots and dislodges the overlying black layer while leaving undisturbed the graphite that is in direct contact with the glass, thereby forming the black matrix.

During the production of high-resolution display tubes, it is important that the rotating trimmer lenses in the 3-in-1 lighthouse be kept free of foreign particles during the three exposure steps. Particles on the lenses may cause an irregular transmission of UV light through the lenses, resulting in a defective black matrix pattern which is unsuitable for high-resolution display tubes. Defective matrix patterns are rejected as scrap, thereby increasing production costs. Thus, it is desirable to keep the three rotating trimmer lenses particle free.

SUMMARY OF THE INVENTION

The present invention comprises an apparatus and method for cleaning a lens system having a plurality of lenses that sequentially move parallel to a shielding plate from a preexposed position to an exposed position located adjacent an aperture in the shielding plate. The apparatus includes a first manifold for directing a first flow of gas across a surface of a lens located at the preexposed position, and a second manifold for directing a second flow of gas across a surface of a lens located at the exposed position. First and second vacuum nozzles remove, respectively, airborne particles within the first and second gs flows. An additional nozzle mounted adjacent the aperture provides an ionized gas.

DETAILED DESCRIPTION OF THE PREFERRED EMBODIMENT

Figure 1:
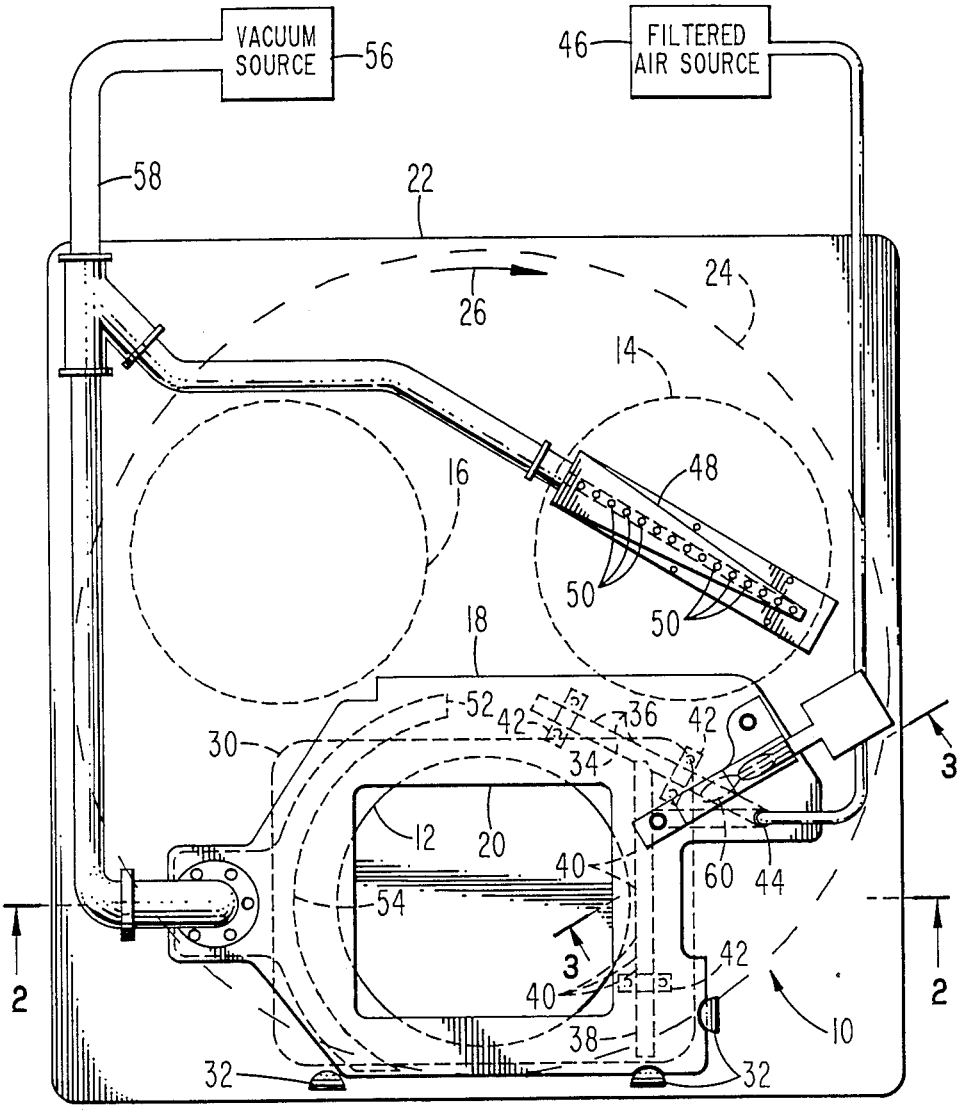
FIG. 1 is a plan view of a 3-in-1 lighthouse having the present lens-cleaning system.
Figure 2:
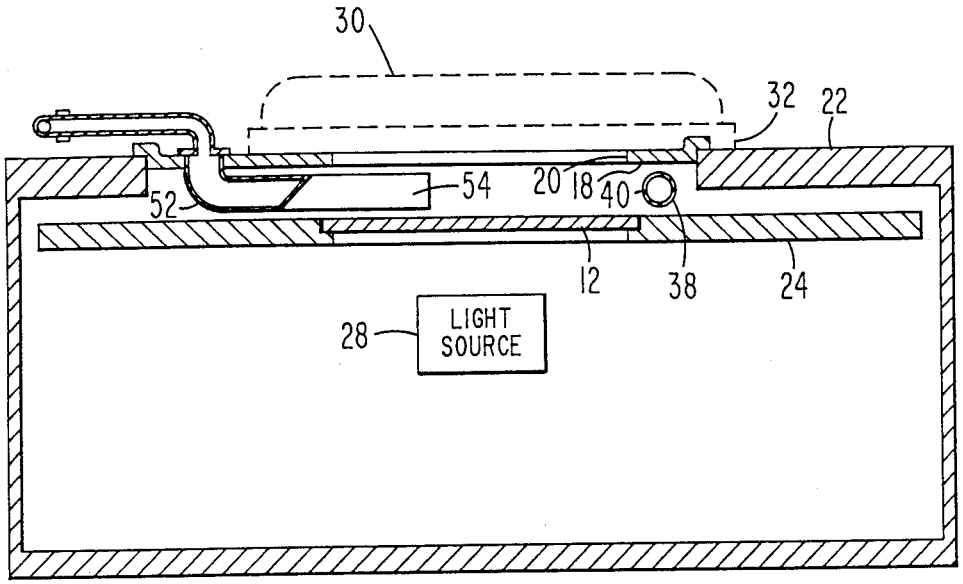
FIG. 2 is a partial cross-sectional view taken along line 2—2 of FIG. 1.

FIGS. 1 and 2 show an apparatus 10 for cleaning a lens system having a plurality of trimmer lenses 12, 14 and 16 that sequentially move parallel to a shielding plate 18 from a preexposed position to an exposed position located adjacent an aperture 20 in the shielding plate 18. The lens system comprises part of a photoexposure apparatus known in the art as a 3-in-1 lighthouse, and the shielding plate 18 forms the upper light shield of the lighthouse. The shielding plate 18 is supported by a top plate 22 of the lighthouse, as shown in FIG. 2. The three lenses 12, 14 and 16 are supported by a rotatable turntable 24 which rotates the lenses 12, 14 and 16 clockwise, as indicated by the arrow 26. At the exposed position, light from a light source 28 passes through the lens 12 in the exposed position and strikes a photosensitive film on the inner surface of a faceplate panel 30 which is supported on a cap locating ring 32, both of which are shown as dashed lines. After exposure through the lens 12, the turntable 24 is rotated until the next lens 14 is located at the exposed position, and the exposure step is repeated. The position of a lens immediately prior to rotatting into the exposed position is hereinafter called the preexposed position.

The lens cleaning apparatus 10 includes a first manifold 34 which is mounted adjacent the preexposed position and has a plurality of orifices 36 therein positioned to direct a first flow of gas therefrom across a surface of a lens located at the preexposed position. A second manifold 38 is mounted adjacent the exposed position and has a plurality of orifices 40 therein positioned to direct a second flow of gas therefrom across the surface of the lens 12 located at the exposed position. Both manifolds 34 and 38 comprise tubes mounted to the underside of the shielding plate 18 above the turntable 24 using brackets 42. The use of the word "orifice" is meant to include any form of nozzle or slit capable of projecting a flow of gas across the respective lens surface. In the present embodiment, the first and the seocnd manifolds 34 and 38 are connected, via a common suuply line 44, to a source 46 of filtered air at a pressure of about 40 p.s.i.

A first vacuum means 48 is mounted adjacent the preexposed position, and positioned opposite the first manifold 34 to receive the first gas flow from the first manifold 34. The first vacuum means 48 comprises a nozzle which is mounted to the topside of the top plate 22 and has a plurality of suction ducts 50 extending through the top plate 22 and substantially along the perimeter of a lens located at the preexposed position. A second vacuum means 52 is mounted adjacent the aperture 20 and positioned opposite the second manifold 38 to receive the second gas flow from the second manifold 38. The second vacuum means 52 comprises a nozzle which is mounted to the underside of the shielding plate 18 above the turntable 24 and has a semicircular suction duct 54 extending along the perimeter of the lens 12 located at the exposed position. Both the first and the second vacuum means 48 and 52 are connected to a common vacuum source 56 via a hose 58.

Figure 3:
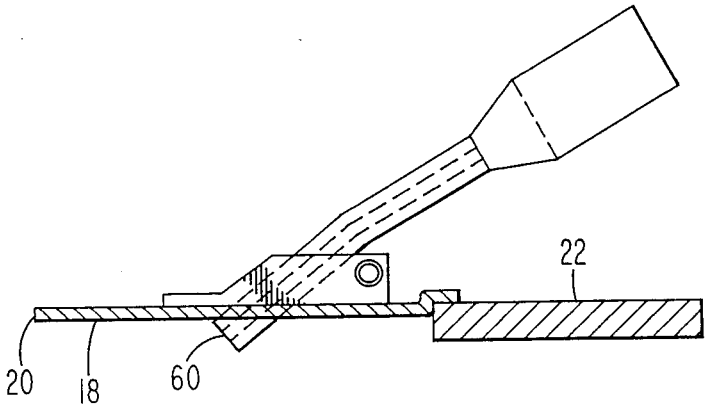
FIG. 3 is a partial cross-sectional view taken along line 3—3 of FIG. 1.

FIG. 3 shows a means mounted adjacent the aperture 20 for providing an ionized gas. In the present example, the providing means comprises a nozzle 60 mounted to the shielding plate 18 and aimed to direct a flow of ionized air substantially along the direction of the second gas flow, as shown in FIG. 1. The nozzle 60 is an HPX-3 nozzle which is one of the HPX series of ionizing nozzles manufactured by Static, Inc.

In operation, the lens cleaning apparatus 10 is activated whenever the turntable 24 is rotated. Preferably, the first and the second vacuum means 48 and 52 are secured by a valve (not shown) shortly after the turntable 24 stops rotating. As the turntable 24 rotates, one of the three lenses 12, 14 and 16 moves into the preexposed position. At this position, a first flow of gas from the orifices 36 in the first manifold 34 is directed across the surface of the preexposed lens, and causes a first group of particles on the preexposed lens to become airborne. This first group of airborne particles comprises undesirable foreign particles, i.e., "dirty air", which is removed by the first vacuum means 48. Preferably, the direction of the first gas flow is substantially parallel to the direction of movement of the lens as it moves away from the preexposed position, so as to maximize the relative movement between the first gas flow and the surface of the lens.

As the turntable 24 continues to rotate, the lens passes through the preexposed position and stops at the exposed position. At this position, a second flow of gas from the orifices 40 in the second manifold 38 is directed across the surface of the lens in the exposed position, causing a second group of particles on the exposed lens to become airborne. This second group of airborne particles is removed by the second vacuum means 52. Preferably, the direction of the second gas flow is substantially parallel to the direction of movement of the lens as it stops at the exposed position. Excellent results in removing foreign particles from the lens are obtained when the direction of the first gas flow is opposite to the direction of movement of the lens as it moves away from the preexposed position, and the direction of movement of the second gas flow is in the same direction as the movement of the lens as it stops at the exposed position.

It is important that there also be provided an ionized gas adjacent the aperture 20 to dislodge electrically charged particles from the lens. In the present example, a flow of ionized air is directed from the nozzle 60 substantially along the direction of the second gas flow. These electrically charged particles then become airborne with the second group of particles and are removed by the second vacuum means 52.

Factory data shown that the present lens cleaning apparatus achieves a five (5) percent scrap reduction for matrix patterns used in high-resolution display tubes. Such a savings reduces production costs significantly, thereby achieving a more economical faceplate panel for display tube production.

What is claimed is:

1. In an apparatus having a plurality of lenses that sequentially move parallel to a shielding plate from a preexposed position to an exposed position located adjacent an aperture in said shielding plate, the improvement comprising:

a first manifold mounted adjacent said preexposed position and having a plurality of orifices therein positioned to direct a first flow of gas therefrom across a surface of a lens located at said preexposed position, said preexposed position being the lens position immediately prior to moving into said exposed position;

a first vacuum means mounted adjacent said preexposed position and positioned opposite said first manifold to receive said first gas flow;

a second manifold mounted adjacent said exposed position and having a plurality of orifices therein positioned to direct a second flow of gas therefrom across a surface of a lens located at said exposed position;

means mounted adjacent said aperture for providing an ionized gas; and a second vacuum means mounted adjacent said aperture and positioned opposite said second manifold to receive said second gas flow.

2. An apparatus as defined in claim 1 wherein the direction of said frist gas flow is substantially parallel to the direction of movement of a lens moving away from said preexposed position, and the direction of said second gas flow is substantially parallel to the direction of movement of a lens stopping at said exposed position.

3. An apparatus as defined in claim 2 wherein the direction of said first gas flow is opposite to the direction of movement of a lens moving away from said preexposed position, and the direction of movement of said second gas flow is in the same direction as the movement of a lens stopping at said exposed position.

4. An apparatus as defined in claim 3 wherein said means for providing an ionized gas comprises a nozzle aimed to direct a flow of ionized air substantially along the direction of said second gas flow.

5. An apparatus as defined in claim 4 having three lenses supported by a rotatable turntable, wherein said shielding plate comprises an upper light shield of a photoexposure lighthouse, wherein said first and said second manifolds and said second vacuum means are mounted to the underside of said light shield above said turntable, and wherein said first vacuum means is mounted to the topside of a top plate of said lighthouse that supports said upper light shield.

6. An apparatus as defined in claim 5 wherein each of said first and said second vacuum emans comprises a nozzle with a plurality of section ducts extending along the perimeter of a lens located at the respective position.

7. An apparatus as defined in claim 6 wherein both vacuum nozzles are connected to a common vacuum source.

8. An apparatus as defined in claim 7 wherein said first and said second manifolds are connected to a common source of filtered air at a pressure of about 40 p.s.i.

9. A method for cleaning a lens system having a plurality of lenses that sequentially move parallel to a shielding plate from a preexposed position to an exposed position located adjacent an aperture in said shielding plate, comprising the steps of:

directing a first flow of gas from a plurality of orifices in a first manifold across a surface of a lens located at said preexposed position to cause a first group of particles on the preexposed lens to become airborne, said preexposed position being the lens position immediately prior to moving into said exposed position;

removing said first group of airborne particles by a first vacuum means mounted adjacent said preexposed position and positioned opposite said first manifold to receive said first gas flow;

directing a second flow of gas from a plurality of orifices in a second manifold across a surface of a lens located at said exposed position to cause a second group of particles on the exposed lens to become airborne;

providing simultaneously an ionized gas adjacent said aperture to dislodge electrically charged particles from a lens disposed adjacent said aperture; and removing said second group of airborne particles by a second vacuum means mounted adjacent said aperture and positioned opposite said second manifold to receive said second gas flow.

10. A method as recited in claim 9 wherein the direction of said first gas flow is substantially parallel to the direction of movement of a lens moving away from said preexposed position, and the direction of said second gas flow is substantially parallel to the direction of movement of a lens stopping at said exposed position.

11. A method as recited in claim 10 wherein the direction of said first gas flow is opposite to the direction of movement of a lens moving away from said preexposed position, and the direction of movement of said second flow is in the same direction as the movement of a lens as it stops at said exposed position.

12. A method as recited in claim 11 wherein said providing stop is performed by directing a flow of ionized air from a nozzle substantially along the direction of said second gas flow.

13. A method as recited in claim 12 wherein each of said first and second vacuum means comprise a nozzle with a plurality of suction ducts extending along a lens located at the respective position.

14. A method as recited in claim 13 wherein both vacuum nozzles are connected to a common vacuum source.

15. A method as recited in claim 14 wherein said first and said second gas flows are provided from a common source of filtered air at a pressure of about 40 p.s.i.

* * * * *